US005291840A

United States Patent [19]

Nakao

[11] Patent Number: 5,291,840

[45] Date of Patent: Mar. 8, 1994

[54] INCINERATOR SYSTEMS

[75] Inventor: Shigeharu Nakao, Chitose, Japan

[73] Assignee: Nakao Co., Ltd., Japan

[21] Appl. No.: 966,760

[22] Filed: Oct. 27, 1992

[30] Foreign Application Priority Data

Oct. 28, 1991 [JP] Japan ..... 3-096662[U]

[51] Int. Cl.[5] ..... F23G 5/00

[52] U.S. Cl. ..... 110/235; 110/211; 110/212

[58] Field of Search ..... 110/235, 211, 212, 233, 110/214

[56] References Cited

U.S. PATENT DOCUMENTS 1,579,642 4/1926 Burns ..... 110/235

4,424,755 1/1984 Caffyn et al. ..... 110/211 X

FOREIGN PATENT DOCUMENTS 4198607 7/1992 Japan ..... 110/235

*Primary Examiner*—Edward G. Favors

[57] ABSTRACT

An incinerator system is built up of an air-permeable base (2), an outer wall (3) extending uprightly therefrom and a front or first furnace (4) and a rear or second furnace (5) set up thereon. The first and second furnaces are each in a vertically extending, cylindrical form and are connected with each other through first, second, third and fourth fume guide pipes (6) to (9), arranged from below, thereby assuring that refuse or trash can be incinerated and maintaining the outer wall at a temperature safe enough to allow access to it.

8 Claims, 12 Drawing Sheets

INCINERATOR SYSTEMS

The present invention concerns an incinerator system.

Referring to a typical example of small incinerator equipment so far available in the art, this is simply built up of a furnace main and a grating or roaster positioned at a lower stage thereof. Air is fed from below the furnace main to burn trash or refuse on the roaster spontaneously, and the combustion gases are discharged through an upper flue pipe into the atmosphere.

Combustion of refuse or trash varies depending upon its type; that is, only combustible matters are sorted out for incineration. The structural material used is chiefly iron or refractory brick. Access to the furnace main is difficult because of radiation of heat, and the floor groundwork on which the incinerator is set up must be resistant to heat. In consideration of environmental pollution, the flue pipe should be of considerable height as well.

This conventional incinerator apparatus has a number of drawbacks. Among them are:

1. To what degree trash burns depends upon where it is located within the furnace; refuse, even though combustible, gives out large amounts of fumes, offensive odors and gases, causing air or other pollution. Far worse, incombustibles such as garbage cannot be incinerated.

2. The furnace, if formed of iron, is so badly oxidized and corroded by heat, wind and rain and the matters to be incinerated that it becomes unserviceable within a short period of time. When formed of refractory brick, it is inconvenient to set up in situ and however small it may be in size, it is heavy and hence troublesome to handle due to the risk of cracking or collapsing during transportation.

3. Access to the furnace is dangerous due to radiation of heat, and the base on which it is set up must be strong enough to stand up to heat and weight.

4. Elevated flue design allows fumes or other exhaust gases to be spewed high above, but is still useless in terms of preventing air pollution and so has to be much improved when it is used in an area crowded with high-rise buildings.

An object of this invention is therefore to solve or reduce the above problems associated with the prior art.

According to this invention, the above object is achieved by the provision of an incinerator system including a base, an outer wall extending uprightly from said base and a front or first furnace set up on the front side of base and a rear or second furnace set up on the rear side of said base respectively, said first and second furnaces being formed in a longitudinally extending cylindrical form and both are connected with each other through first, second, third and fourth fume guide pipes arranged from below in sequence, wherein:

said first furnace is built up of a bottomed cylindrical body having an openable cap member on its upper opening, a dish form of ash receiver provided at the lowermost end of said cylindrical body, a roaster applied over the upper face of said ash receiver and a flame diffuser on and across the upper face of said roaster, said flame diffuser comprising a hollow column extending uprightly from the centre of the upper face thereof, a first burner connected to the rear end thereof, a vertical duct connected to the other end thereof and an upper duct connected to the left side said vertical duct, said second furnace is built up of a bottomed cylindrical body including a ceiling having on its upper opening a connector which is in a short hollow column for connection to a vertical flue, an air feed pipe which terminates in said cylindrical body and is diametrically decreased at its upper portion to be inserted into said connector, a blower attached to the lower end of said air feed pipe, a second burner attached below the junction between said cylindrical body and said third fume guide pipe, an upper, horizontally extending plate for enhancing heating, which is provided on the front inner wall of said cylindrical body and is positioned below the location of said second burner and a lower, horizontally extending plate for enhancing heating, which is provided on the rear inner wall of said cylindrical body and is positioned on the rear inner wall of said cylindrical body and is positioned below the location of said upper plate for enhancing heating.

Preferably said base is permeable to air and said outer wall uprightly extending from the side of said base consists of a triple structure, the air permeability of said base communicating within said outer wall.

By way of example, a specific embodiment of the invention will now be described with reference to the accompanying drawings in which.

Figure 1:
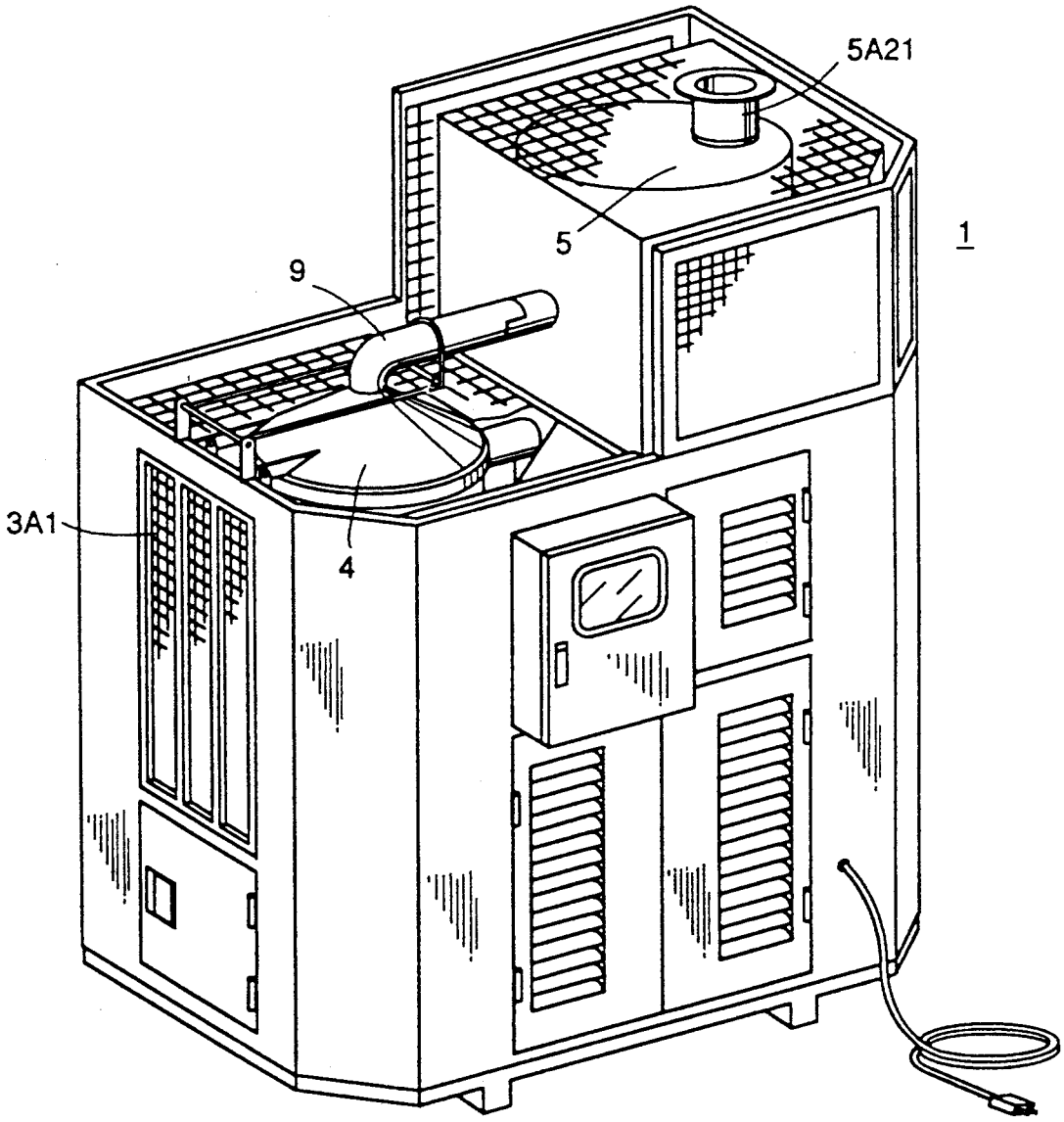
FIG. 1 is a front perspective view of one embodiment of the incinerator system according to this invention.
Figure 2:
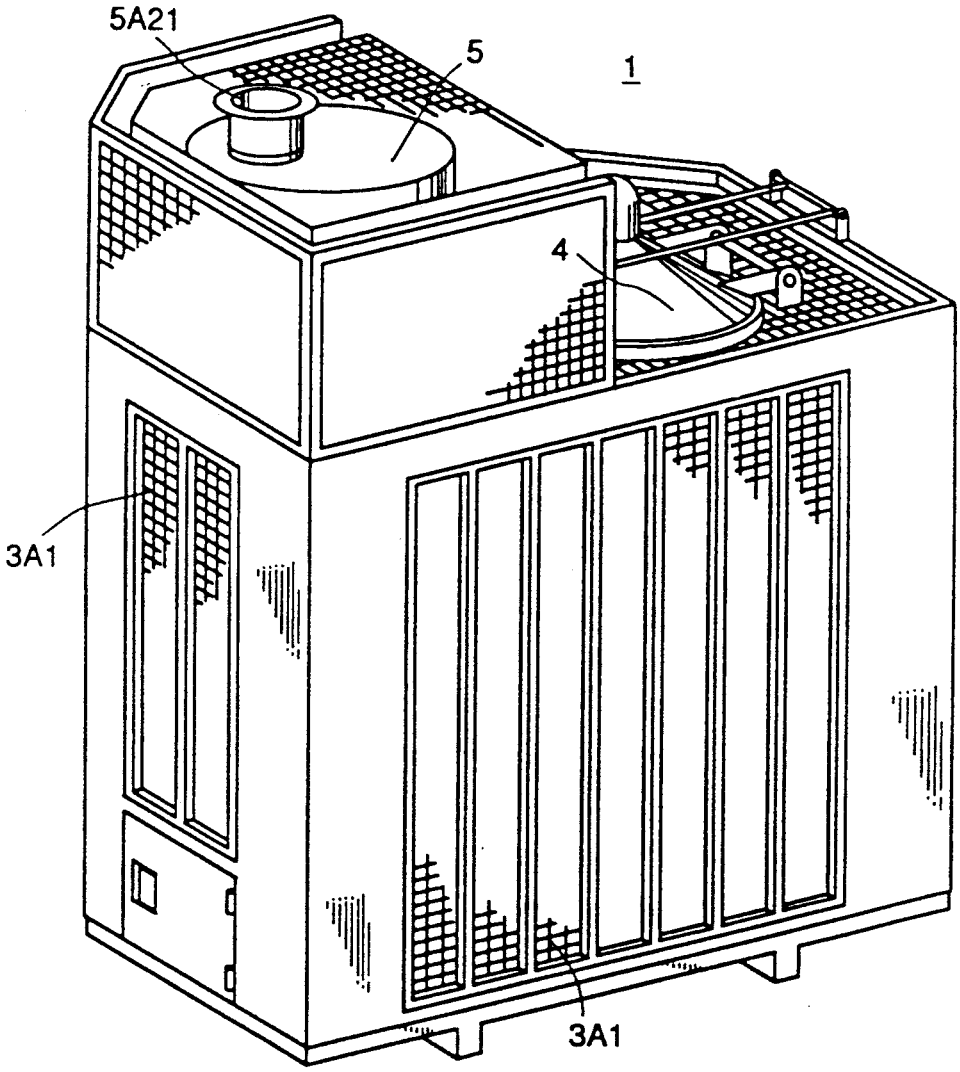
FIG. 2 is a rear perspective view of that embodiment.

Referring to the drawings, there is shown an embodiment of the incinerator system, shown at 1, according to this invention. As a whole, this system is built up of an air-permeable base 2 and an outer wall 3 which extends uprightly from the side of the base 2. As will be understood from the ensuing description, this outer wall 3 surrounds the first (front) and second (rear) furnaces 4 and 5 which are set up on the base 2.

In what follows, these components will be explained in sequence.

Figure 4:
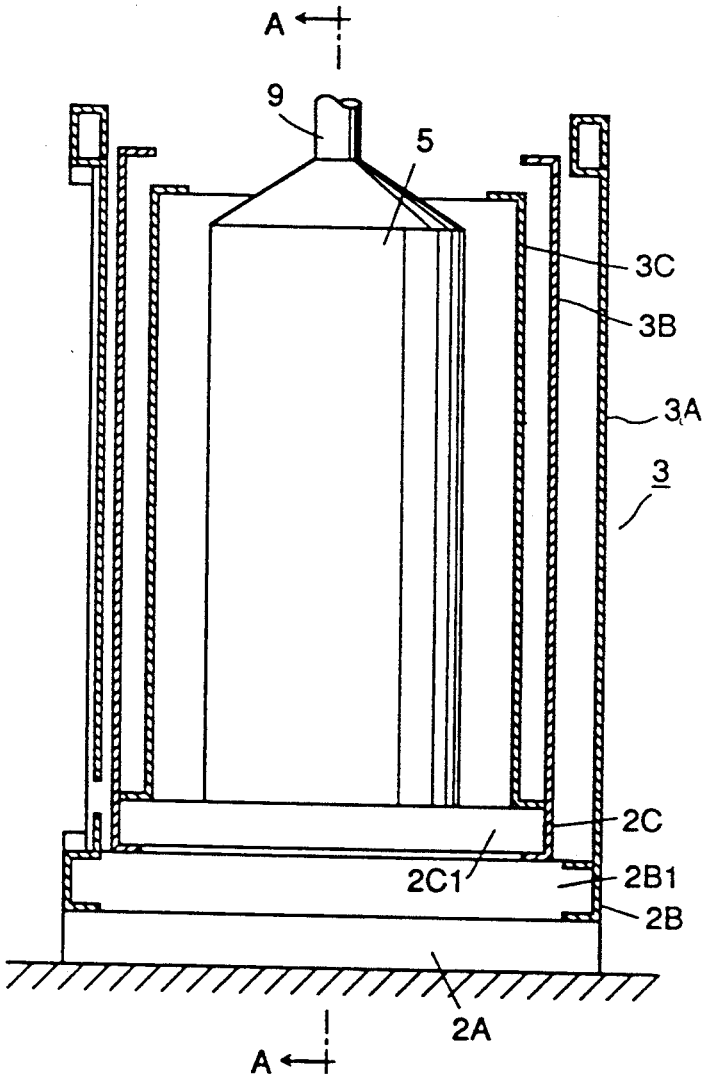
FIG. 4 is a schematically longitudinal section of that embodiment.
Figure 5:
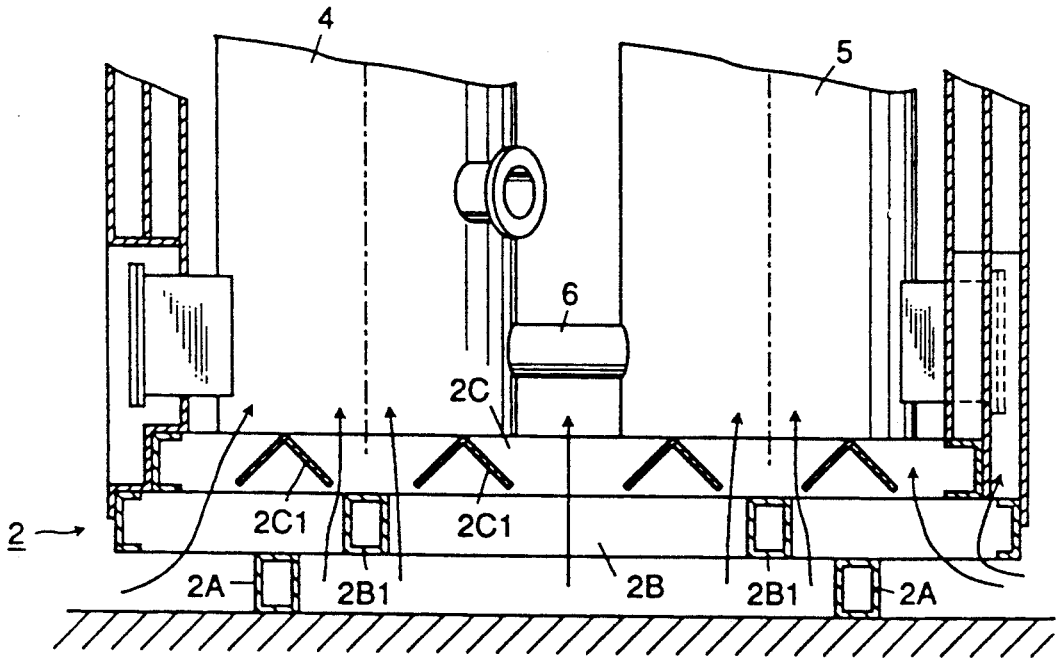
FIG. 5 is a partly omitted, sectional view taken along the line A—A of FIG. 4.
Figure 6:
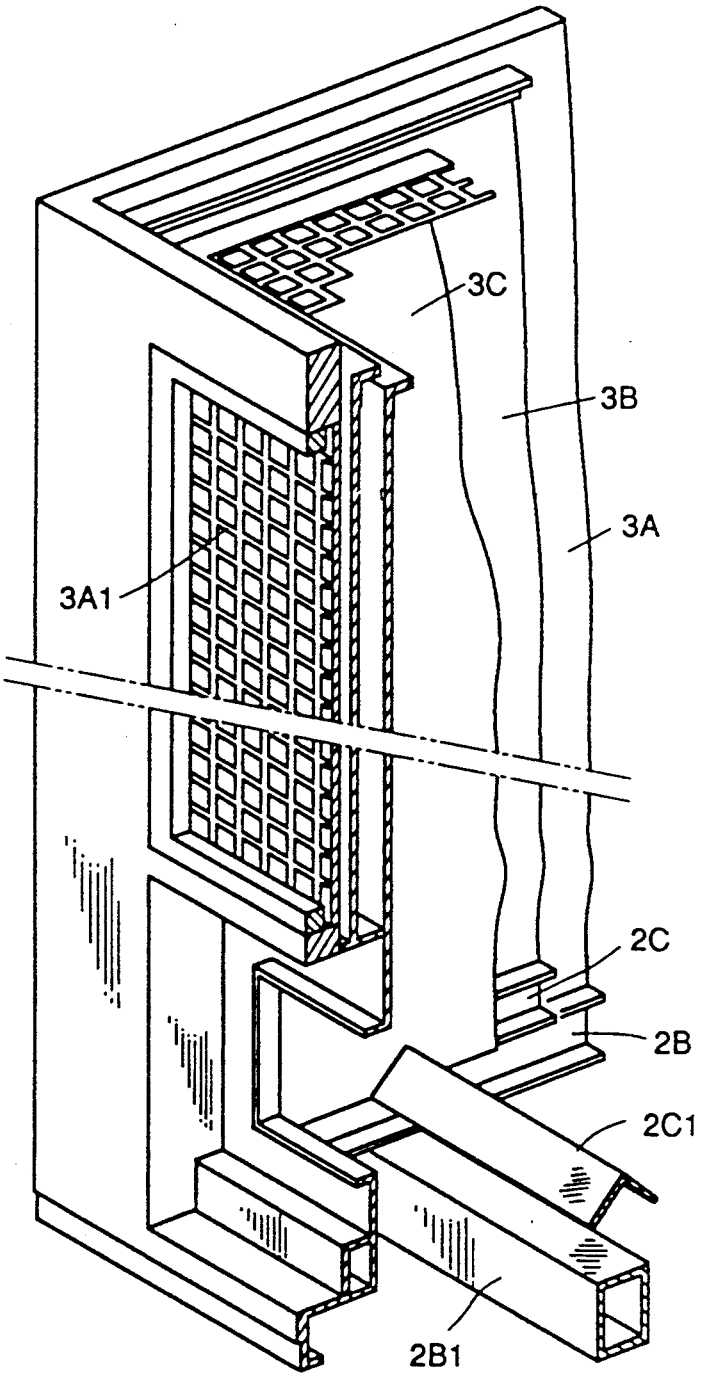
FIG. 6 is a partly cutaway, perspective view illustrating the relation between the base and the outer wall.
Figure 7:
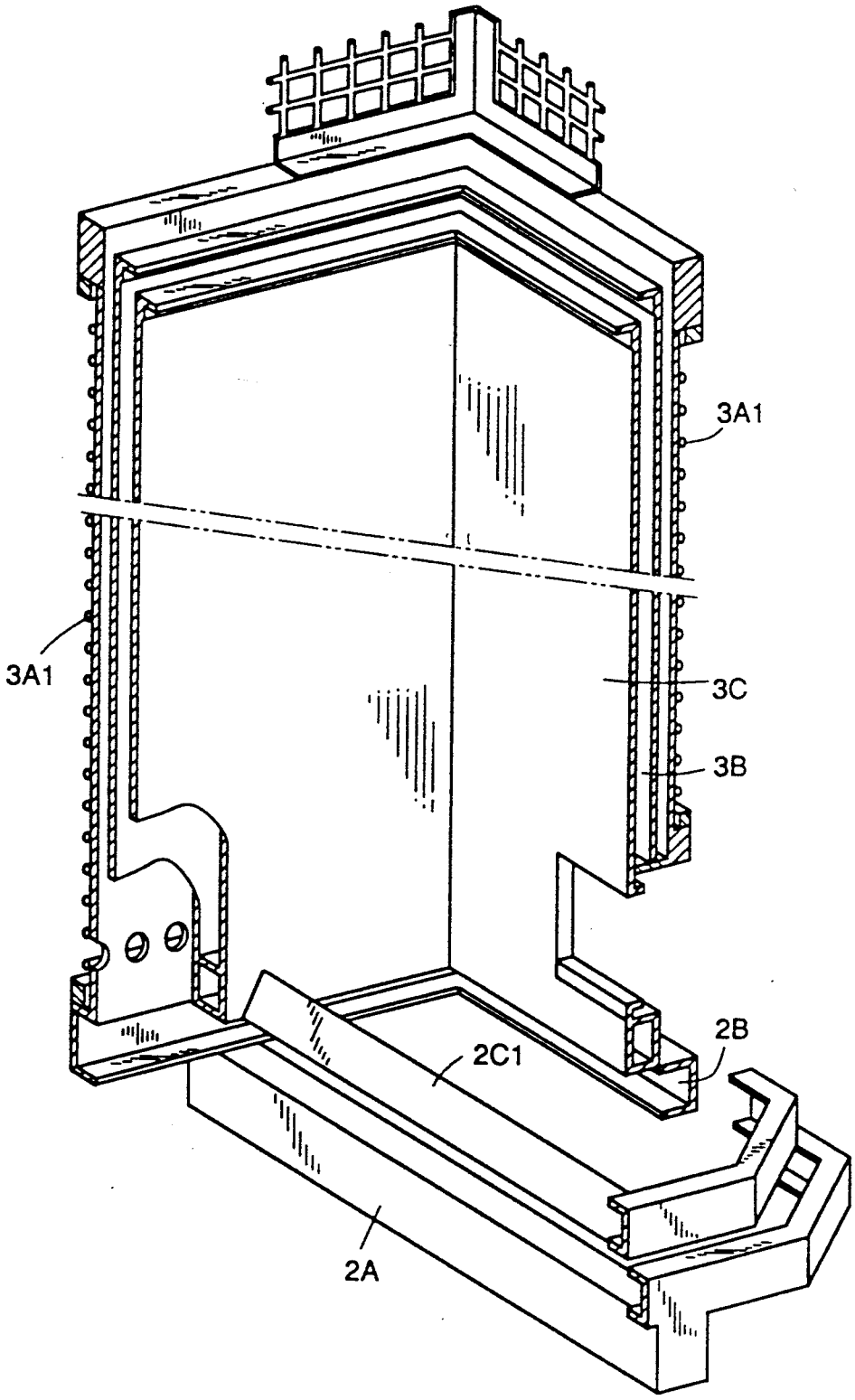
FIG. 7 is another view, similar to FIG. 6, illustrating the relation between the base and the outer wall.

As can be best seen from FIGS. 4 and 5, the base 2 is built up of horizontally extending front and rear rectangular members 2A, a lower frame 2B of a substantially rectangular shape in plane, which is fixed on the upper faces of members 2A; a plurality of support rods 2B1 extending through the lower frame 2B at a given interval; an upper frame 2C placed on the upper faces of support rods 2B1; and a plurality of support rods 2C1 extending through the upper frame 2C at a given interval.

As can be best seen from FIGS. 4 to 7, the outer wall 3 is of a triple structure or, to be specific, comprises an outer wall member 3A extending uprightly from the lower frame 2B of base 2; an intermediate wall member 3B extending uprightly from the upper frame 2C of base 2; and an inner wall member 3C provided on the inside of intermediate wall member 3B.

A metal net 3A is provided at front, left and rear side portions of said outer wall 3A.

Figure 8:
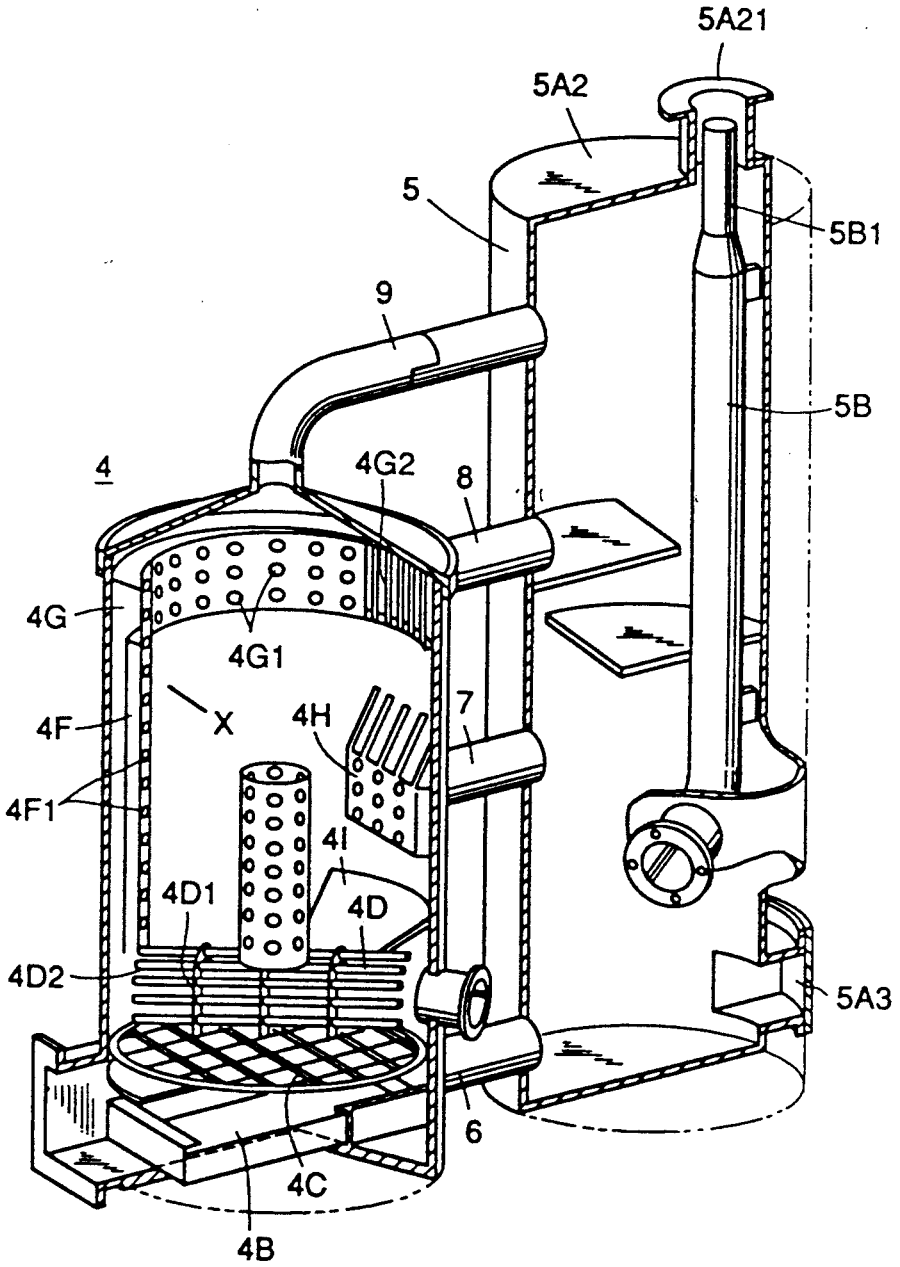
FIG. 8 is a partly cutaway, perspective view illustrating the relation between the first and second furnaces.
Figure 9:
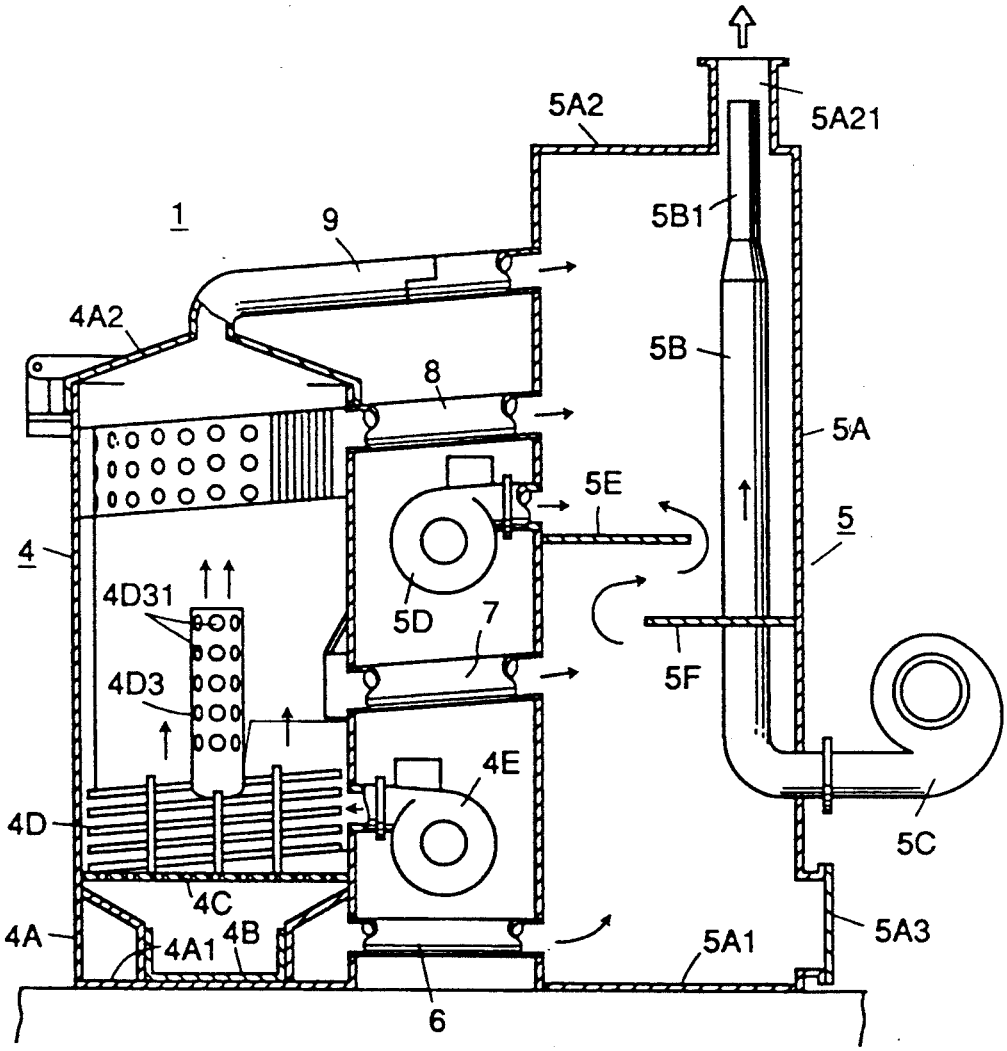
FIG. 9 is a longitudinally sectioned view showing the relation between the first and second furnaces.

As well illustrated in FIGS. 8 and 9, the first and second furnaces 4 and 5 are each in a longitudinally extending cylindrical form, and are connected with each other by way of a first fume guide pipe 6, a second fume guide pipe 7, a third fume guide pipe 8 and a fourth fume guide pipe 9 positioned from below in this order.

The first furnace 4 will now be explained more specifically with reference to FIGS. 8 and 9.

This furnace 4A refers to a cylindrical body having a bottom 4A1, which has an openable conical cap member 4A2 on its upper opening.

On top of this cap member 4A2 there is connected the fourth fume guide pipe 9.

Figure 3:
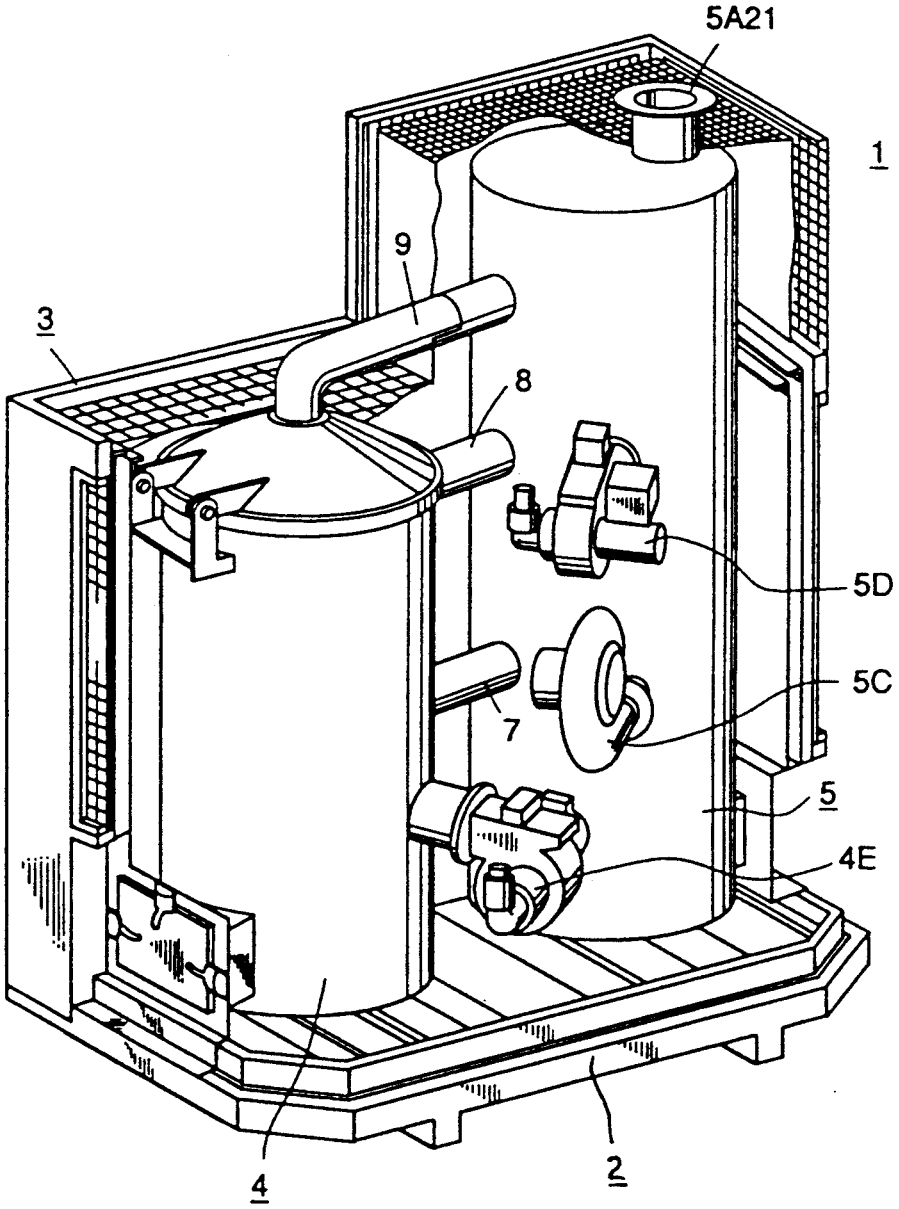
FIG. 3 is a partly cutaway, front perspective view of that embodiment.

As can be understood from FIG. 3, the fourth fume guide pipe 9 is releasably attached at its centre to the openable cap member 4A2.

At and in the lowermost end of the cylindrical body 4A there is a dish form of ash receiver 4B which is removable from within the furnace, and on the upper face of ash receiver 4B there is placed a roaster 4C, which is connected on its lower face with the first fume guide pipe 6. On and across the upper face of roaster 4C there is place a flame diffuser 4D, which is built up of upward semi-circular members 4D1 and a suitable number of round rods 4D2 running through and perpendicularly to the members 4D1.

Extending uprightly from the centre of the upper face of flame diffuser 4D is a hollow columnar member 4D3 having an array of round holes 4D31.

The flame diffuser 4D is connected at its rear end with a first burner 4E located externally of the furnace and at its front end with a vertical duct 4F having an array of round holes 4F1, which is connected with an upper duct 4G at its upper end and on its left side. The upper duct 4G has an array of round holes 4G1 as well. On the endmost portion of upper duct 4G it is connected with the third fume guide pipe 8. A grating 4G2 is placed at the junction of the upper duct 4G and the third fume guide pipe 9.

A baffle 4H is placed on the junction of the cylindrical body 4A and the second fume guide pipe 7, and is provided with an array of round holes on its surface and with crosspieces on its upper face. Bear in mind that 4I stands for an inclined guide plate.

In the ensuing description, the second furnace 5 will be explained specifically with reference to FIG. 9.

A cylindrical body 5A has a bottom 5A1 and a ceiling 5A2. Said ceiling is provided on its upper opening with a short column form a connector 5A21 so as to be connected to a vertical flue pipe (not shown).

Below and on the rear side of the cylindrical body 5A there is a cleaner 5A3.

An air feed pipe 5B drawn into the cylindrical body 5A from outside of said cylindrical body 5A, is diametrically reduced at its upper portion 5B1 and is inserted into the above connector 4A21. At the lower end of pipe 5B there is attached a blower 5C.

A second burner 5D is placed below the junction of the cylindrical body 5A and the third fume guide pipe 8.

An upper, horizontally extending plate 5E for the purpose of enhancing heating is attached to the front inner wall of cylindrical body 5A and below the location of the second burner 5D.

A lower, horizontally extending plate 5F for the purpose of enhancing heating is attached to the rear inner wall of cylindrical body 5A and below the location of the upper plate 5E.

Figure 10:
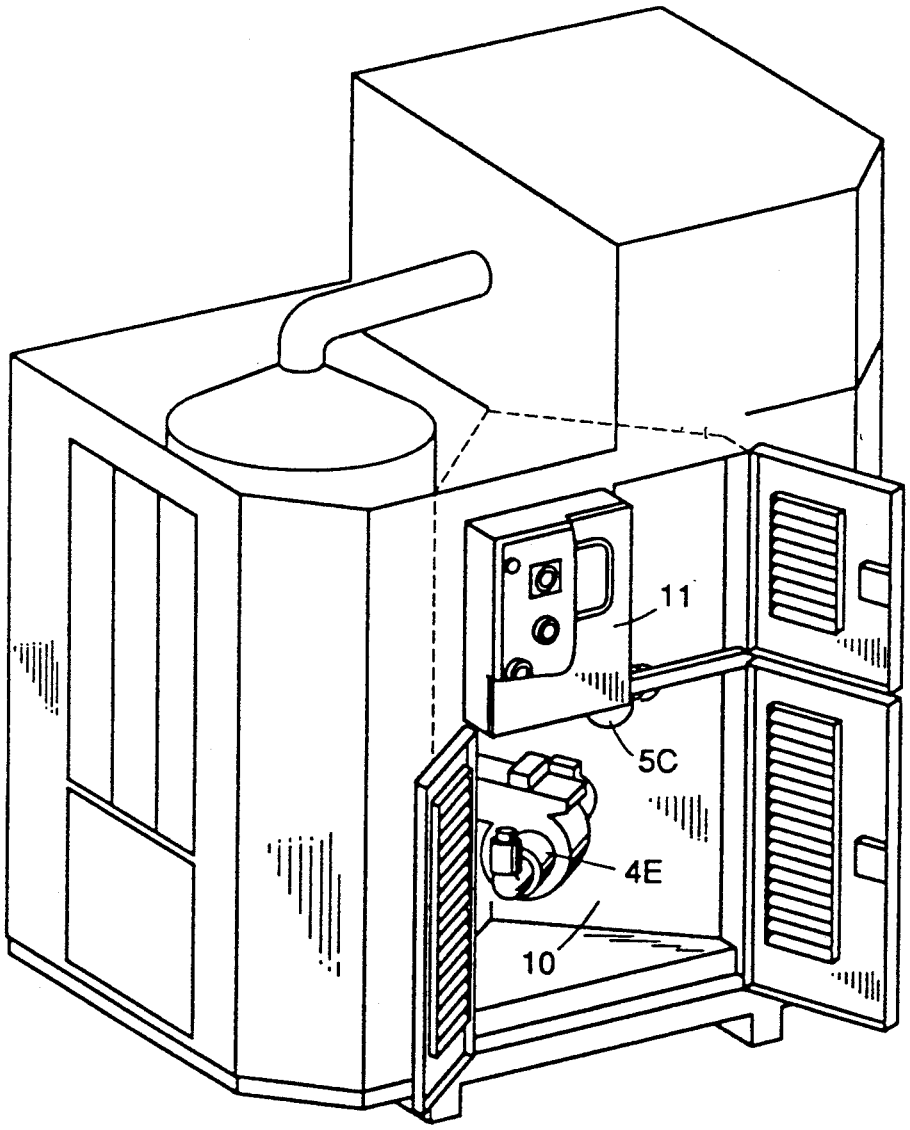
FIG. 10 is a perspective view showing the mechanic chamber mainly.
Figure 11:
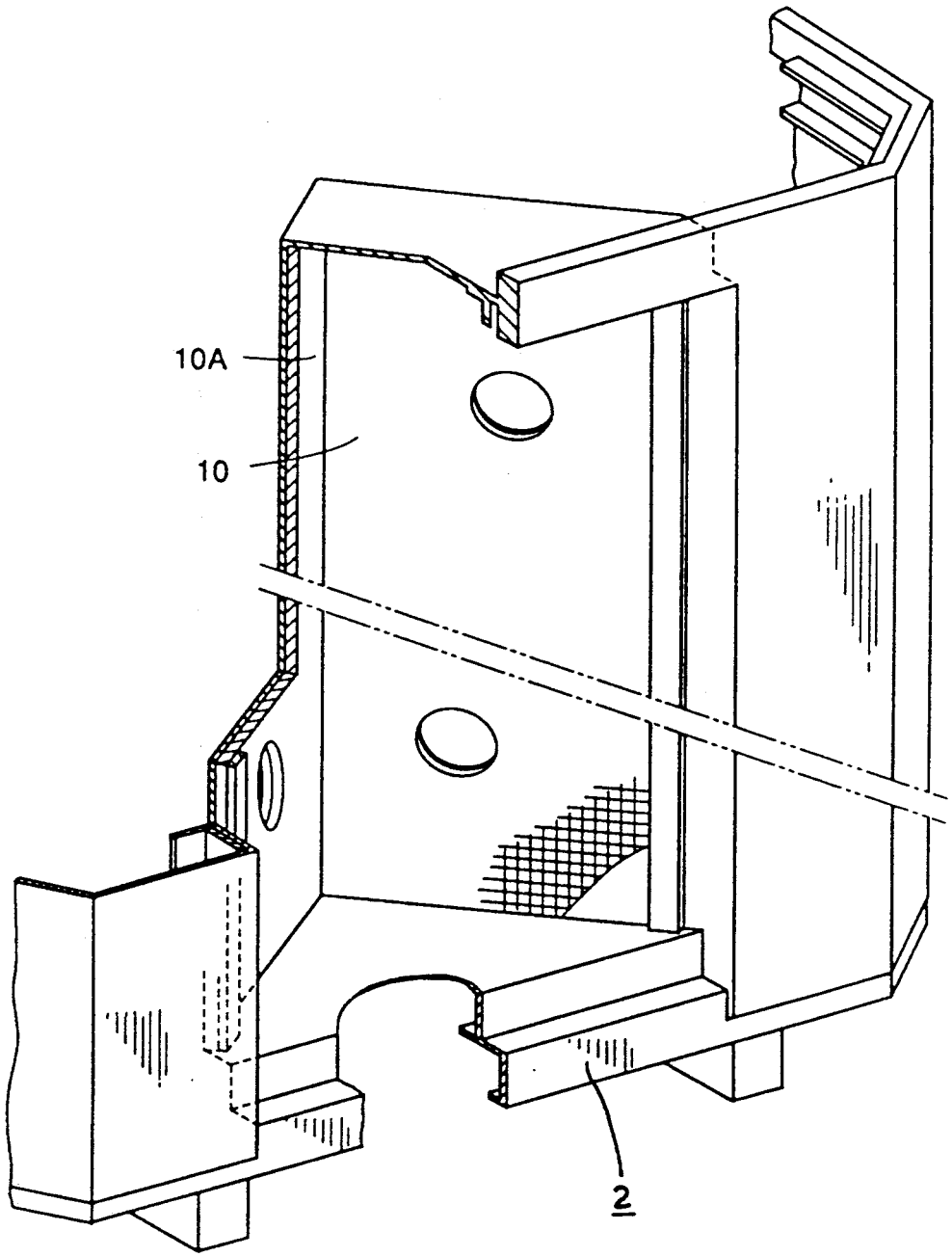
FIG. 11 is a partly cutway, enlarged perspective view showing parts of FIG. 10.
Figure 12:
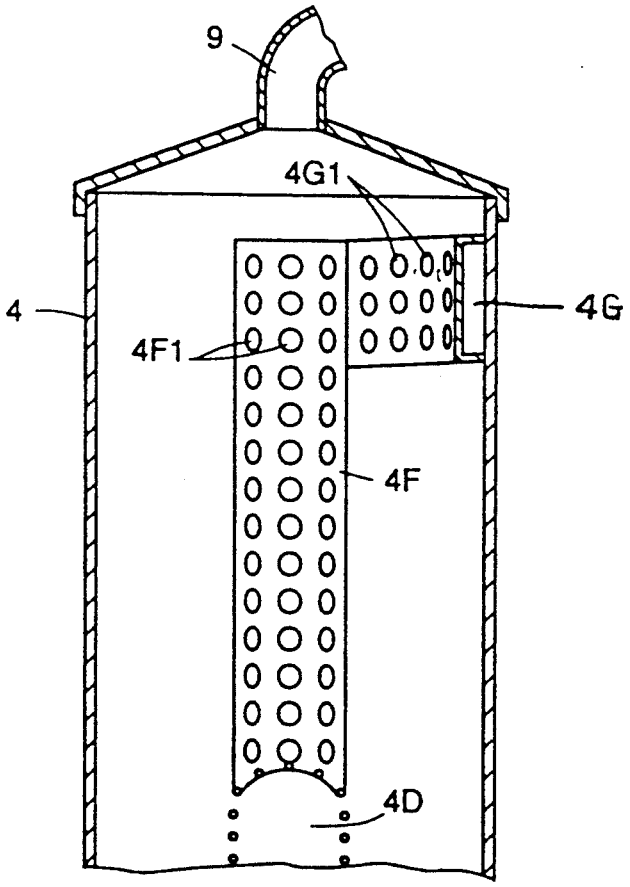
FIG. 12 is an enlarged sectional view as viewed in the direction shown by an arrow X.

As can be well seen from FIGS. 3, 10 and 11, between the front or first furnace 4 is provided in the front side of base 2 and the rear or second furnace 5 is provided in the rear side of base 2, there is defined a triangular space in which a machinery chamber 10 is housed. In this case, the chamber 10 is provided with an insulating material so as to provide an insulating protection against heat from the first and second furnaces. As disclosed, this chamber 10 receives the first burner 4E, the blower 5C and second burner 5D.

The chamber 10 receives a control panel 11 as well.

The incinerator system constructed according to this invention has the following effects.

1. Refuse or trash fed onto the roaster 4C of the first furnace is heated by heat or heated air supplied by the first burner 4E thereby drying, thermal decomposition, and generating dry gases or giving rise to combustion with flames are effected. This heating is promoted by the flame diffuser 4D and vertical flue 4D3.
2. Incomplete combustion gases of spontaneously incombustible gases or fumes are guided from the vertical duct 4F—near to the region they are generated—through the upper duct 4G and fume guide pipes 6–9 into the second furnace 5 where they are forcedly subjected to complete combustion by heat and heated air supplied from the second burner 5D.
3. The gases or fumes from the fume guide pipes 6 to 9 are generally exposed to higher temperatures as they go up; hence, their residence time and temperature are such controlled by the lower and upper plates 5F and 5E so as to achieve complete combustion. Note that air for burning garbage or unburned gases is supplied also by blowers attached to each burner for burning burner oils. Thus, combustion can be placed under control by operating the dumpers for sucking air into the burners.
4. The air supplied from the blower 5C is fed through the diametrically reduced region of the pipe 5B at an increased rate into the pipe 5B, that is, the internal pressure of the furnace is so reduced that they are entrained in an mixed with the high-speed stream for discharge with no substantial leakage of the combustion gases out of the furnace.
5. The cap member 4A2 is so openable that in case there is an unusual increase in the pressure prevailing in the furnace (by a locally catching fire etc), it can also serve as a safety valve to release the pressurized gases.
6. By reason of the triple structure consisting of the inner, intermediate and outer wall members 3C, 3B and 3A which the air flows upwardly from the bottom, the air heated between the walls ascend and is released from above, while fresh cold air is spontaneously sucked from the bottom.

For that reason, the conduction of heat from the first and second furnaces 4 and 5 to the outer wall 3A is so much reduced that it can be kept at a temperature safe enough to allow access to it.

No special care is needed for insulating the region on which the base is set up, because of a cold air flow constantly passes through it.

The reader's attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

I claim:

1. An incinerator system comprising:

a first furnace including a first hollow cylindrical body having an upper end and a lower end;

an ash receiver disposed in the lower end of said first hollow cylindrical body;

a roaster positioned above said ash receiver;

a flame diffuser positioned above and across said roaster, said flame diffuser including a first end and a second end;

a first burner connected to said first end of said flame diffuser;

a second furnace including a second hollow cylindrical body having an upper end and a lower end with an opening formed in said upper end including connector means for connection to a flue;

an air feed pipe disposed within said second hollow cylindrical body having an upper end positioned within said connector means and a bottom end attached to a blower means;

a second burner attached to said second hollow cylindrical body and in communication with the interior thereof; and, a plurality of fume guide pipes connecting the interiors of said first and second hollow cylindrical bodies and spaced from bottom to top between said first and second hollow cylindrical bodies.

2. The incinerator system of claim 1, further including an air permeable base on which said first and second furnaces are disposed.

3. The incinerator system of claim 2, further including a wall structure disposed on said base and surrounding said first and second furnaces, said wall structure including spaced inner, intermediate and outer wall members.

4. The incinerator system of claim 1, wherein said first hollow cylindrical body of said first furnace has an opening at its upper end and an openable cap member disposed on said opening.

5. The incinerator system of claim 1, wherein said flame diffuser further includes duct means connected to the second end thereof and a hollow column extending upwardly from said diffuser.

6. The incinerator system of claim 1, wherein said second hollow cylindrical body of said second furnace further includes first and second horizontal plates for enhancing heating extending from an inner wall of said second hollow cylindrical body, said first horizontal plate being positioned below the location of said second burner and said second horizontal plate being positioned below and opposite from said first horizontal plate.

7. The incinerator system of claim 1, wherein said air feed pipe is diametrically decreased at the upper end thereof.

8. An incinerator system comprising:

a first furnace including a first hollow cylindrical body having an upper end and a lower end, said upper end having an opening formed therein;

an ash receiver disposed in the lower end of said first hollow cylindrical body;

a roaster positioned above said ash receiver;

a flame diffuser positioned above and across said roaster, said flame diffuser including a first end and a second end;

a first burner connected to said first end of said flame diffuser;

duct means connected to the second end of said flame diffuser;

a hollow column extending upwardly from said flame diffuser;

an openable cap member disposed on said opening in said upper end of said first hollow cylindrical body;

a second furnace including a second hollow cylindrical body having an upper end and a lower end with an opening formed at said upper end including connector means for connection to a flue;

an air feed pipe disposed within said second hollow cylindrical body having an upper end positioned within said connector means and a bottom end attached to a blower means, said air feed pipe being diametrically decreased at the upper end thereof;

first and second horizontal plates for enhancing heating extending from an inner wall of said second hollow cylindrical body, said first horizontal plate being positioned below the location of said second burner and said second horizontal plate being positioned below and opposite from said first horizontal plate;

a plurality of fume guide pipes connecting the interiors of said first and second hollow cylindrical bodies and spaced from bottom to top between said first and second hollow cylindrical bodies;

an air permeable base on which said first and second furnaces are disposed; and, a wall structure disposed on said base and surrounding said first and second furnaces, said wall structure including spaced inner, intermediate and outer wall members.

* * * * *